343-754
8/4/87 XR 4,684,954 SR

United States Patent [19]
Sureau et al.

[11] Patent Number: 4,684,954
[45] Date of Patent: Aug. 4, 1987

[54] ELECTROMAGNETIC ENERGY SHIELD

[75] Inventors: Jean-Claude Sureau, Boston; Steven S. Krystofik, Hudson, both of Mass.

[73] Assignee: Radant Technologies, Inc., Stow, Mass.

[21] Appl. No.: 766,545

[22] Filed: Aug. 19, 1985

[51] Int. Cl.[4] ..... H01Q 15/02
[52] U.S. Cl. ..... 343/909; 343/754; 343/872; 343/908
[58] Field of Search ..... 343/754, 872, 908, 909

[56] References Cited

U.S. PATENT DOCUMENTS 4,419,761 12/1983 Noerpel ..... 743/786
4,518,966 5/1985 Sadones ..... 343/754
4,574,288 3/1986 Sillard et al. ..... 343/909

*Primary Examiner*—Robert E. Wise
*Assistant Examiner*—Doris J. Johnson
*Attorney, Agent, or Firm*—Robert F. O'Connell

[57] ABSTRACT

A radome shutter structure for preventing the transmission of electromagnetic energy within a selected frequency range and for permitting the transmission of energy outside such frequency range during a first mode of operation and for permitting the transmission of electromagnetic energy over a relatively wide frequency range which includes such selected frequency range during a second mode of operation. The structure includes an insulative substrate having a symmetrical array of metallized regions, each region preferably in the form of a Jerusalem Cross having discontinuous arms interconnected by diode elements which are placed in a conductive state in the first mode of operation and in a non-conductive state in the second mode of operation.

13 Claims, 14 Drawing Figures

ELECTROMAGNETIC ENERGY SHIELD

INTRODUCTION

This invention relates generally to structures for selectively transmitting electromagnetic energy, and, more praticularly, to structures arranged so that at selected times the transmission of electromagnetic energy therethrough is permitted only in a selected portion of the frequency spectrum and that at other times the transmission therethrough of energy in any portion of the frequency spectrum is substantially reduced. Such structures can be used, for example, as radome structures for shielding electronic equipment from external incident electromagnetic energy.

BACKGROUND OF THE INVENTION

Radome structures are conventionally used to protect equipment, such as microwave antennae, from the physical environment. It is also desirable to shield such equipment from external incident electromagnetic energy which can adversely affect the electrical operating characteristics thereof. Such a shield, during the operation of the equipment, e.g., an antenna system, should be transparent to the energy only in the selected frequency range handled by the antenna equipment and only when the equipment is placed into operation. When the equipment is not operating, such a shield should reject electromagnetic energy within such frequency range as well as outside such frequency range.

Radome shields having such characteristics are often referred to as "shutter-type" radomes, the shutter being effectively "closed" to all frequencies both within and outside the frequency band of interest during non-operation and the shutter being effectively "open" only to frequencies in the desired operating frequency operating portions of the spectrum during operation, e.g. when antenna equipment within the radome is operating.

Another shutter arrangement for providing what has sometimes been referred to as "complementary" shutter operation is disclosed in U.S. Patent application Ser. No. 642,536 now U.S. Pat. No. Des. 287,592, filed by Jean-Claude Sureau on Aug. 20, 1984, in which transmission of electromagnetic energy through the structure is permitted in the "open" shutter mode over a relatively wide frequency band which is generally established as being substantially wider than a particular frequency band of interest. During such mode the structure is essentially operating as a non-resonant structure. In the "closed" shutter mode, the structure is made essentially resonant at the center frequency of the desired selected frequency band so as to effectively suppress all transmission at such center frequency and to substantially reduce the energy in the remaining portion of the selected frequency band about the center frequency. Such a structure is said to operate as a suppression resonant structure as opposed to the above described transmission resonant shutter structure and, hence, the use of the term "complementary". Such a structure normally utilizes a symmetrical pattern of symmetrical conductive elements with diodes interconnecting adjacent conductive elements both in the horizontal and vertical directions. When the diodes are appropriately biased in a conductive direction (forward biased) the shutter operates in its open shutter mode and when the diodes are in their non-conductive state (reverse or zero biased) the shutter operates in a closed shutter mode.

However, is some applications requiring such a complementary shutter operation it may be desirable, and in some cases necessary, to provide shutter operation in the opposite sense, that is, to produce a closed complementary shutter operation when the diodes are forward biased and to produce an open complementary shutter operation when the diodes are reverse or zero biased. For example, in some environments when the equipment which is protected by the radome shutter structure is operating, there may not be power available for biasing the diodes in the appropriate manner and, accordingly, the operative condition needs to be arranged so that it can be effected without using power for diode biasing purposes.

BRIEF SUMMARY OF THE INVENTION

In accordance with the invention, a radome shutter structure is provided which is placed in a closed or shut position when the diodes are biased in a forward or conductive state and is placed in an open condition when the diodes are reversed biased or in a non-conductive state.

A particular embodiment of the structure of the invention utilizes a pattern of metalized cross configurations on one surface of a suitable insulative substrate, the arms of each of the crosses being discontinuous, and the discontinuous portions thereof being interconnected by PIN diodes. On the reverse surface of the substrate a pattern of rectangular metalized grid elements is formed, the open grid portions essentially corresponding to the portions of the metalized portions on the other side. When the diodes are in their conductive or forward biased state, the overall panel behaves analagously to a series resonant circuit shunting a transmission line and provides the desired "closed" operating conditions. When the diodes are reversed biased, or in a non-conductive state, the metalized cross regions on one surface act as isolated metal patches which are essentially capacitive in nature, while the metalized grid pattern on the reverse surface of the substrate is essentially inductive in nature so that the combination behaves analagously to a parallel resonant circuit shunting a transmission line so as to provide the desired "open" mode of operation.

DESCRIPTION OF THE INVENTION

The invention can be described in more detail with the help of the accompanying drawings wherein:

FIG. 1 shows in simplified diagrammatic form a perspective exploded view of an overall structure in which the invention can be used;

FIG. 2 discloses in more detail a portion of the metalization structure shown on one surface of the shutter structure of the invention;

Figure 1:
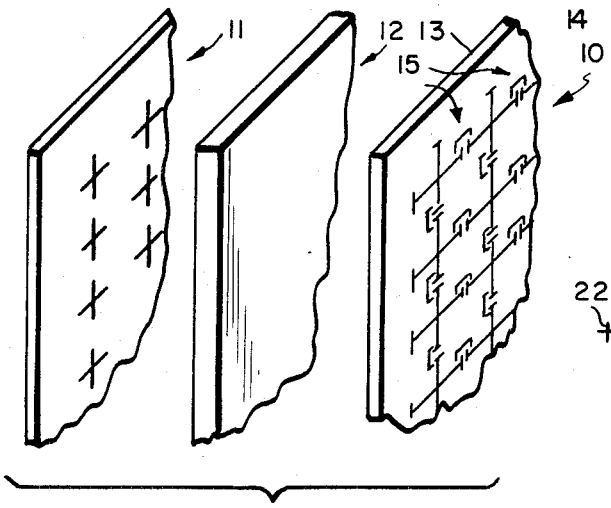

As can be seen in FIG. 1, the invention can be used in an environment wherein an active shutter structure 10 thereof is utilized in combination with a passive band pass structure 11, the active shutter structure being spaced approximately $\lambda_0/4$ from the passive filter structure, where $\lambda_0$ represents the wavelength at the center frequency $f_o$ of the suppression or "notch" filter desired during the operating state of the overall system.

For such purpose the active shutter structure 10 is separated from the passive band pass structure 11 by a suitable spacer element 12 which may be in the form of a plastic, or other suitable type, honeycomb material or a suitably shaped foam structure.

The active shutter structure 10 comprises a substrate 13, one surface 14 of which has positioned thereon a pattern of metalized regions 15. A typical metalized region 15 is shown in more detail in FIG. 2 each region being referred to, for convenience, as a unit cell region outlined by dot-dash line 16 therein. Such region is configured in the general form of a cross, the arms 18 of which are formed as discontinuous metalized elements 18A and 18B separated by a gap 18C as shown. The discontinous elements of each arm are interconnected by diodes 19. Each cross can be preferably formed as a cross potent, or Jerusalem Cross, having orthogonal end regions 20 at the outer end of each arm 18. The end regions 20 of adjacent unit cells are interconnected by suitable metalized bias wire regions 21 as shown.

An appropriate power supply can be used to supply bias voltages to the diodes, the power supply inputs being depicted diagrammatically as having positive inputs 22 and negative inputs 23. Thus, two arms of the cross in each unit cell are connected to the positive bias input and the other two arms to the negative bias input and such bias inputs are interconnected from cross-to-cross by bias wire regions 21. Thus the bias inputs are connected to an appropriate side of the diodes associated with each arm, such diodes having the relative polarities depicted. Accordingly, when the bias inputs are supplied from the power supply, all of the diodes are conductive. When no bias inputs are supplied from the power supply, the diodes are non-conductive.

Figure 3:
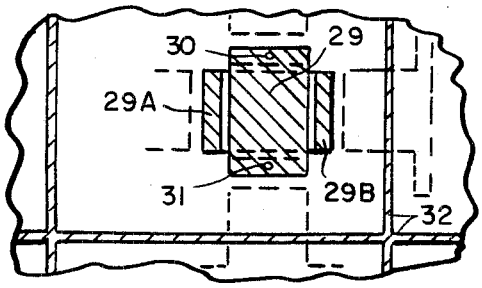
FIG. 3 shows a portion of the metalization structure shown on the reverse side of the structure of FIG. 2.

The center portion of the cross which includes a portion of the discontinuous arms is effectively divided into three metalized regions 24, 25 and 26 separated by non-metalized regions, or gaps, 27 and 28. Regions 24 and 26 are interconnected on the reverse side of substrate 13 as shown in FIG. 3 utilizing a metallic element 29 having through-put holes 30 and 31 which are plated through, so as to provide an electrical connection from metalized region 24 to metalized region 26. A pair of separate metallized elements 29A and 29B are positioned on either side of the element 29. In addition, the reverse side of substrate 13 has a metalized grid 32 formed thereon, each of the open portions of the grid corresponding in their periodicity to the unit cell regions 16 on the other side thereof and roughly corresponding in positions thereto although with a slight displacement therefrom both vertically and horizontally, as shown. The diodes 19 utilized in each of the discontinuous arms of the the crosses in each unit are PIN diodes and are appropriately connected across the gaps 18C in each arm.

Figure 2:
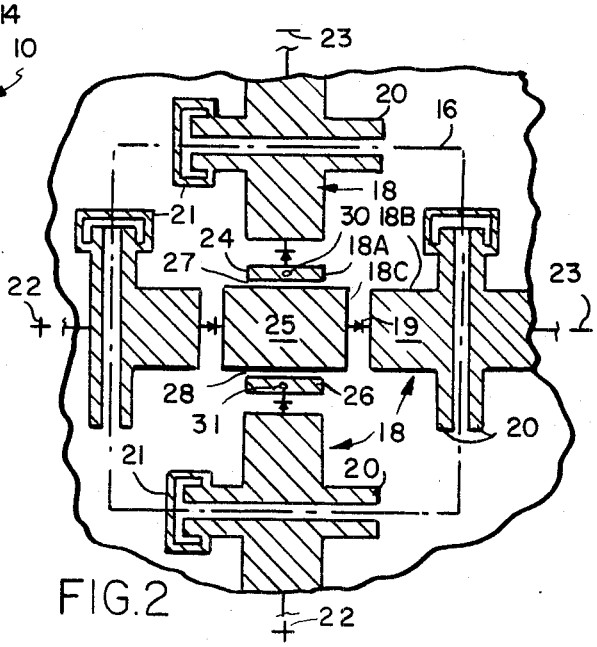

In the structure of FIG. 2, metalized region 25 provides a current path for the horizontally positioned diodes in one pair of opposite arms while the metalization element 29 on the reverse side together with the plated holes 30 and 31 provides a current path for the vertical diodes in the other pair of opposite arms.

Figure 4:
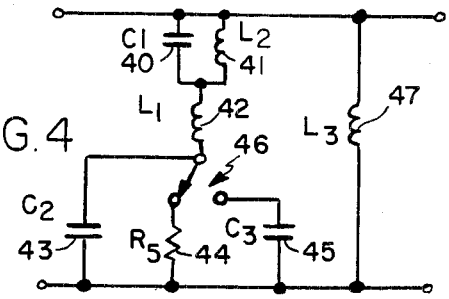
FIG. 4 shows a circuit diagram representing an equivalent circuit of the shutter structure of the invention.

Operation of the overall shutter structure can be described electrically in accordance with the operation of the equivalent circuit shown in FIG. 4 as follows. The shutter panel 10 may be considered electrically equivalent to a transmission line having a shunt circuit which comprises a parallel combination of capacitance 40 and inductance 41 (having capacitance and inductance values $C_1$ and $L_2$, respectively) connected in series with inductance 42 ($L_1$) which is in turn connected to a parallel combination of capacitance 43 ($C_2$) either in parallel with a resistance 44 ($R_5$) or a capacitance 45 ($C_3$) depending on the position of switch 46. Such circuit is then further in parallel with an inductance 47 ($L_3$).

Switch 46 in effect represents the condition of the diodes, i.e., whether the diodes are forward biased or reverse biased. When forward biased (diodes are conducting and the panel is in effectively its "closed" condition) the switch is in the position shown in FIG. 4 and provides a parallel combination of capacitance 43 and resistance 44. When the diodes are reverse biased the panel is in the "open" condition represented by the opposite panel of switch 46 which provides a parallel combination of capacitance 43 and capacitance 45.

Figure 5:
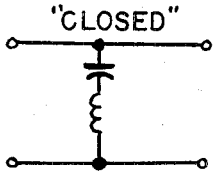
FIG. 5 shows a simplified equivalent circuit of the shutter structure of the invention in its "closed" state.
Figure 6:
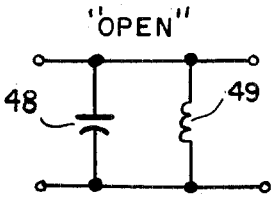
FIG. 6 shows a simplified circuit diagram of the shutter structure of the invention in its "open" state.

Thus, with the diodes forward biased (in the equivalent switch position shown in FIG. 4) the panel is in its "closed" state and behaves essentially as a series resonant circuit shunting the transmission line, the resonance being set by the dominant elements $L_1$ and $C_1$ as depicted in the simplified circuit of FIG. 5. When the diodes are reverse biased the panel is in its open state and the metalization pattern shown in FIG. 2 acts as a plurality of isolated metal patches in each unit cell which produces a capacitive effect. The metalized grid on the reverse side of the panel, as shown in FIG. 3, acts effectively as an inductive element. Such combination thereby behaves as a parallel resonant circuit shown in simplified form in FIG. 6 wherein the effective capacitance 48 represents the combined capacitive effect of the metalization regions on the side of the panel shown in FIG. 2 while the inductance 49 represents the effect of the inductive element on the reverse side of the panel, partially shown in FIG. 3.

Figure 5A:
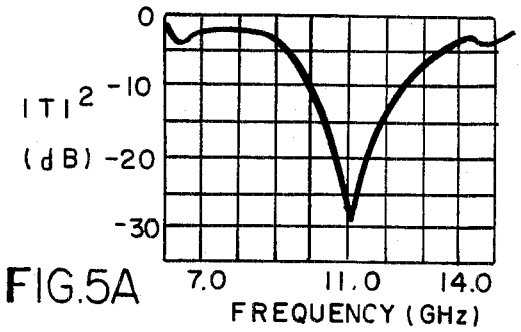
Figure 6A:
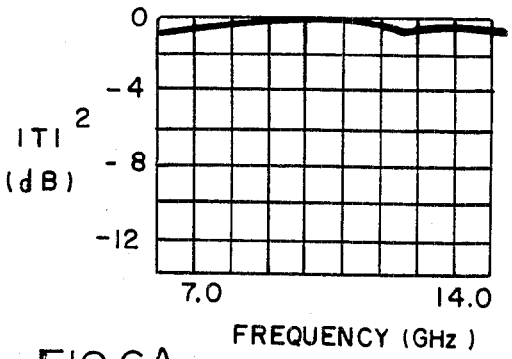

FIG. 5A depicts the response of the panel to incoming radiation over a frequency range from about 7 GHz to about 14 GHz and, as can be seen therein, the panel in its "closed" state acts in effect as a "notch" filter in which electromagnetic energy is prevented from being transmitted through the panel in the notch region having a center frequency at about 11 GHz. Electromagnetic energy below 7 GHz and above 14 GHz is effectively transmitted through the panel since the effective series resonant circuit of FIG. 5 acts only to suppress the transmission over the particular band width as exemplarily shown in FIG. 5A. In contrast, during the open state of the panel the response is that of a parallel resonant circuit of FIG. 6 as shown in FIG. 6A wherein not only is electromagnetic energy above and below 7 and 14 GHz, respectively, permitted to be transmitted therethrough but also energy within the previously suppressed notch region of the spectrum (from 7 to 14 GHz).

Figure 7:
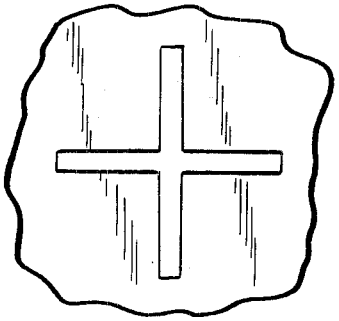
FIGS. 7, 7A and 7B show various types of metalization configurations which can be utilized in repetitive patterns in the passive filter layer of the overall structure of FIG. 1.
Figure 7A:
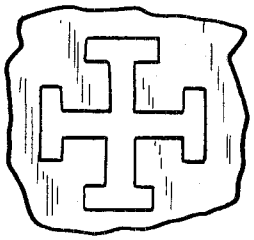
Figure 7B:
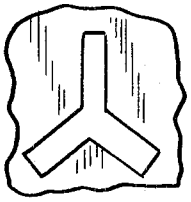
Figure 8:
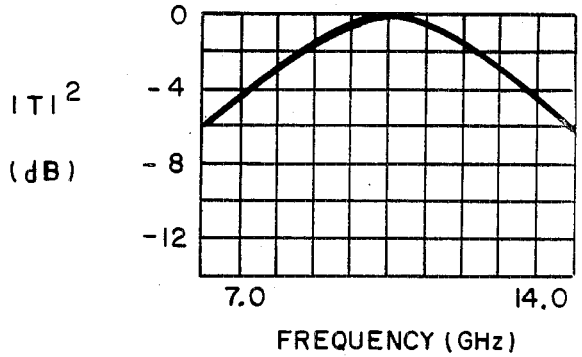
FIG. 8 shows a graph of a typical response characteristic of the passive filter structure of FIG. 1 utilizing a configuration in accordance with a configuration of FIGS. 7, 7A or 7B.
Figure 9:
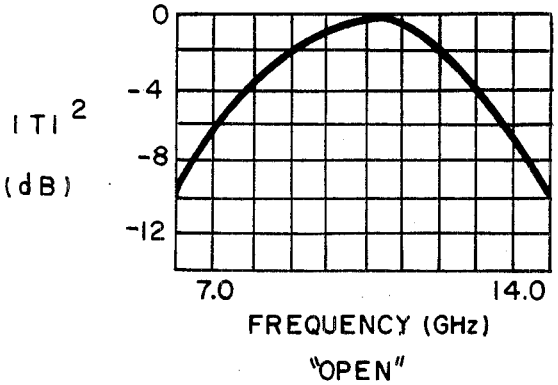
FIG. 9 shows a typical response of an overall structure of the type shown in FIG. 1 when the shutter portion thereof is in its "open" state.
Figure 10:
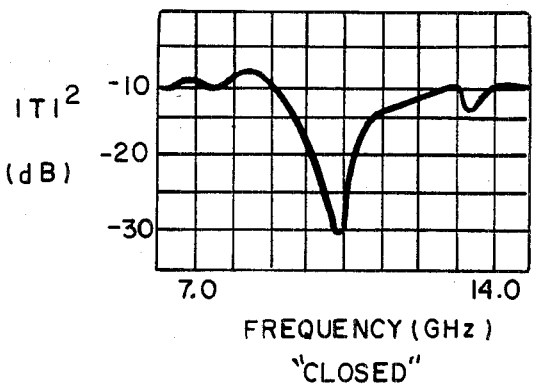
FIG. 10 shows a graph of a typical response of the overall configuration of FIG. 1 when the shutter portion thereof is in its "closed" state.

A panel 14 constructed in accordance with the metalization patterns on each side, as depicted in FIGS. 2 and 3, can be used in combination with a passive band pass panel 11 as shown in FIG. 1 when spaced therefrom by approximately a quarter wavelength at the center frequency of the suppression resonant band shown in FIG. 5A. Such passive filter panels are well known to the art and comprise, for example, an insulative substrate having a metallized surface on which is formed an array of suitably shaped non-metallized slots, as in the exemplary forms of simple slots, Jerusalem cross slots, or tripole slots, shown in FIGS. 7, 7A and 7B, respectively. Other slot configurations may be devised as desired by those in the art. The dimensions and spacings thereof are arranged in accordance with known techniques so as to provide a response characteristic of the exemplary type shown in FIG. 8 over a particular frequency range of interest (e.g. 7 GHz to 14 GHz), i.e., a passive pass band operation wherein substantially all of the energy transmitted over that frequency range is permitted to be transmitted through the band pass panel structure. Accordingly, the band pass operation of the passive band pass layer can be effectively represented as a filter having a higher-Q or steeper cutoff frequency points, than that shown in the open state active filter of FIGS. 6 and 6A. The combination of the passive band pass panel and the active diode shutter panel in the open state thereby provides an overall response which reflects out of band energy as shown in FIG. 9. In the closed state, which occurs when the diodes of the active shutter layer are switched to provide a series resonant notch filter operation, energy is reflected over all of the frequencies of concern as shown in FIG. 10.

The complementary shutter structure of the invention differs from that shown in the above referenced Sureau application in that it is in a "closed" state when the diodes are forward biased and in an "open" state when the diodes are reverse biased. Morever the equivalent circuit operation of the active shutter is different from the equivalent circuit operation of the aforesaid application.

The shutter of the invention has a design symmetry so that it functions in the same manner for horizontal, vertical and circular polarizations at normal incidence and the design can be physically scaled in size to operate at any desired frequency depending on the application. Further the transmission loss in the "open" state is less than 0.5 dB up to a 60° incident angle in both the E and H planes.

In a particular embodiment described, the metalization layers can be fabricated by photo-etching the patterns on an appropriate fiberglass subpanel, such as a Teflon fiberglass panel. Typically, such substrates may be 5 mil. thick using copper as the metalization material. The dielectric constant thereof is 2.50 and such substrates can be purchased under the designation of Type 601 from Oak Materials Group Inc. of Franklin, N.H. The PIN diodes may be purchased, for example, as diode Types 5082-3900 from Hewlett Packard Corporation of Palo Alto, Calif.

While the particular embodiments described are preferred embodiments of the invention, modifications thereof within the spirit and scope of the invention may occur to those in the art. Hence, the invention is not to be limited to the particular embodiments described except as defined by the appended claims.

What is claimed is:

1. A structure for preventing the transmission of electromagnetic energy within a selected frequency range and for permitting the transmission of electromagnetic energy outside said frequency range during a first mode of operation and for permitting the transmission of electromagnetic energy over a relatively wide frequency range including said selected frequency range during a second mode of operation, said structure comprising an insulative member, a plurality of regions containing conductive elements positioned in a symmetrical array on at least one surface of said structure, portions of the conductive elements in each region being interconnected by diode elements;

means for placing said diode elements in their conductive state in a first diode mode of operation to permit the transmission of electromagnetic energy over said relatively wide frequency range and for placing said diode elements in their non-conductive state in a second diode mode of operation to prevent the transmission of electromagnetic energy in said selected frequency range and to permit the transmission of electromagnetic energy outside said selected frequency range.

2. A structure in accordance with claim 1 wherein the conductive elements in each of said regions in the form of a plurality of metallized portions are interconencted by diode elements.

3. A structure in accordance with claim 2 wherein said metallized portions are generally in the shape of a Jerusalem cross, the arms of which are discontinuous, the discontinuous portions of each of said arms being connected by diode elements.

4. A structure in accordance with claim 2 and further wherein a second surface of said insulative member opposite to said first surface has a conductive grid pattern formed thereon, said conductive grid pattern being substantially inductive in nature and the conductive regions on said first surface being substantially capacitive in nature when said diode elements are in their non-conductive state.

5. A structure in accordance with claim 4 wherein the arrangement of the open portions of said grid pattern on said second surface generally corresponding to the arrangement of the array of regions of conductive elements on said first surface but being displaced therefrom.

6. A structure in accordance with claim 1 wherein said diode elements are PIN diodes.

7. A structure in accordance with claim 1 wherein said substrate is a fiberglass substrate the conductive regions on the surfaces thereof being formed as metallized layers thereon using photo-etching techniques.

8. A structure in accordance with claim 1 wherein the thickness of said substrate is about 5 mil.

9. A structural combination comprising a shutter structure in accordance with claim 1; and a filter structure mounted adjacent to and spaced from said shutter structure said filter structure comprising an insulative substrate having at least one metallized surface;

an array of non-metallized slot regions in said metallized surface said slot regions being arranged to cause said filter structure to operate as a passive filter permitting the transmission of electromagnetic energy over a second selected frequency range.

10. A structural combination in accordance with claim 9 wherein said filter structure is spaced from said shutter structure at a distance substantially equal to the wavelength at the center frequency of said first selected frequency range.

11. A structural combination in accordance with claim 9 wherein said slot regions are in the shape of crosses.

12. A structural combination in accordance with claim 11 wherein in said slot regions are in the shape of tripole slots.

13. A structural combination in accordance with claim 9 wherein the center frequency of said second frequency range corresponds to the center frequency of said first frequency range.

* * * * *